US007069857B1

(12) United States Patent
Marshall

(10) Patent No.: US 7,069,857 B1
(45) Date of Patent: Jul. 4, 2006

(54) METHOD FOR CREATING A TWO-SIDED PICTURE

(75) Inventor: Marten Dwight Marshall, Sunset Beach, CA (US)

(73) Assignee: Marten Marshall, Sunset Beach, CA (US)

( * ) Notice: Subject to any disclaimer, the term of this patent is extended or adjusted under 35 U.S.C. 154(b) by 0 days.

(21) Appl. No.: 10/715,305

(22) Filed: Nov. 17, 2003

(51) Int. Cl.
*B41M 3/00* (2006.01)
*B41M 3/12* (2006.01)
*B44C 3/02* (2006.01)

(52) U.S. Cl. ..... 101/485; 101/483

(58) Field of Classification Search ..... 101/483, 101/485; 428/29, 58; 40/615; 156/60, 277
See application file for complete search history.

(56) References Cited

U.S. PATENT DOCUMENTS

| | | | | |
|---|---|---|---|---|
| 2,096,180 | A * | 10/1937 | Friedrich | 428/201 |
| 4,879,161 | A | 11/1989 | Raymond | |
| 5,144,328 | A * | 9/1992 | Blake et al. | 347/101 |
| 5,968,617 | A | 10/1999 | Jones | |
| 6,030,740 | A | 2/2000 | Polykarpov | |
| 6,064,848 | A | 5/2000 | Haneda | |
| 6,142,620 | A * | 11/2000 | Sagi | 347/101 |
| 6,562,171 | B1 | 5/2003 | Archie, Jr. | |
| 2002/0039632 | A1 * | 4/2002 | Hicks | 428/38 |

FOREIGN PATENT DOCUMENTS

| | | | |
|---|---|---|---|
| CN | 2216261 | Y | 12/1995 |
| JP | 09030100 | A * | 2/1997 |
| JP | 2001010298 | A * | 1/2001 |
| JP | 2002002085 | A * | 1/2002 |

OTHER PUBLICATIONS

Machine translation of JP 2001010298 to Sodeyama from Japanese Patent Office website.*

* cited by examiner

*Primary Examiner*—Daniel J. Colilla

(57) ABSTRACT

A method for creating a picture that has two sides is described. The picture has an image with a bottom layer (2), a white middle layer (3) and a top layer (4). The single image that results, when printed on a transparent medium, presents one image when seen from the front and a different image when viewed from the back, through the transparent medium. The two sided image may be printed on a transparent medium as in FIGS. (2) and (4), or it may be printed on decal material and placed on a transparent object such as a glass as in (6) and (7). Two sided text may be added as in (8), (9) and (10). The two sided image may be combined with other two sided images as in (15) and (16). Two sided decals may be placed on plastic and cut out as in (17).

6 Claims, 4 Drawing Sheets

METHOD FOR CREATING A TWO-SIDED PICTURE

CROSS-REFERENCE TO RELATED APPLICATIONS

Not applicable

FEDERALLY SPONSORED RESEARCH

Not applicable

SEQUENCE LISTING OR PROGRAM

Not applicable

BACKGROUND OF THE INVENTION

1. Field of the Invention

This invention relates generally to a method for creating a two-sided picture

2. Background

Two-sided printing has usually meant printing one image on one side of a medium and printing a different image on the other side of the medium, such as is normally done when printing text and pictures on both sides of a piece of paper in a newspaper or book. Improvements in two sided printing have primarily involved improved ways to print two separate images on two sides of a single medium, such as in U.S. Pat. No. 6,064,848, or in new digital printer media allowing simultaneous processing of printed images on both sides of a single medium, such as in U.S. Pat. No. 6,030,740.

Other two sided printing improvements have described methods for printing on one side of a medium and then applying an adhesive and folding, resulting in a single object with images printed on both sides, such as in U.S. Pat. No. 6,562,171. Another example of this is Chinese patent CN 2,216,261Y, which describes a method to create a transparent dual-sided photo. This invention also requires creating 2 separate images and then using an adhesive to hold them together.

The abovementioned inventions all require printing two separate images on two different sides of a medium, or creating 2 images and attaching them together.

Alternatively, another way to accomplish two-sided printing has been via the use of a two-sided decal, such as is described in U.S. Pat. No. 5,968,617. The decal in this invention, however, must be viewed through a transparent cylindrical object such as a glass. For that reason, it is not really a two-sided image, but rather a method of simultaneously viewing two separate images that have been printed in two different locations on different sides of a single decal.

Still another alternative has been to create a two-sided display that shows images from both sides, such as is described in U.S. Pat. No. 4,879,161. This invention covers the making of two-sided visual displays printed on a transparent medium for attachment to a window, screen or object. With this method both sides of the display must be identical mirror images, which is a significant limitation. In order for the display to be seen from either side it is also required that no backing or underlayment color be used. The patent itself acknowledges that an underlayment layer would improve the appearance of the display.

Therefore, the devices and methods for two-sided printing are all deficient. Deficiencies of previous methods include, but are not limited to the following: a) Improvements in printing on two sides of a medium have added nothing to the end product; they have merely provided a faster or cheaper way to produce what was done previously. The end product looks no different than if it had been printed on one side of a medium and then turned over and printed on the other side. b) Methods that describe printing two separate images and then attaching them together with an adhesive have only provided another improvement for printing. Other than a double thick medium held together with adhesive, the end product again looks no different than what has been done previously. c) Methods that create new and unique two-sided images such as U.S. Pat. No. 5,968,617 have severe limitations. It must, for example, be viewed through a transparent cylindrical object. It also has not really created a two-sided picture, merely a way to view 2 separate images on two sides of the medium simultaneously. d) Other methods that create identical front and back images that can be viewed from two sides have serious limitations. Since the front and back views are the same image, any novelty of the end product is greatly diminished. In addition although the images are identical, one side must be a mirror image of the other side; so any image that cannot be properly viewed as a mirror image, such as text, cannot be used. This method also fails to provide for any underlayment to the image thus degrading the quality of the image.

It is therefore an object of the present invention to provide a new and unique method to create a two-sided image. In addition to a new way to create the image, another objective of this invention is to produce an end product that is novel and unique.

It is yet another object of the present invention to provide an aesthetically pleasing image that can serve the same purpose as conventional portraits and photographs, but in an entirely new visually pleasing and informative manner.

It is a further object of the present invention to create a two-sided image that does not require printing two separate images and attaching them together. The image created should be a single image printed on only one side of a medium. It should not require attaching two images together. The created image should also not have excessive restrictions on how it is viewed or where it is placed.

Still further, it is an object of the present invention to provide an image that provides one view when seen from the front and a different view when seen from the back. By use of the methods described herein it is possible to create an image that shows the front and back of the image in the same picture. The image thus created has wide applications from personal photographs of people and objects, to instructional applications on how to use an item or product, to new and novel ways to attract attention to a product at point of sale or for promotional applications.

SUMMARY OF THE INVENTION

The present invention advantageously fills the aforementioned deficiencies in the prior art by providing a new, non-obvious and useful method for creating a two-sided picture.

In accordance with the present invention, a two-sided picture normally has three layers printed on a transparent medium. The first layer is the bottom layer; this is the image that will be seen when viewed from the back or bottom through the transparent medium. The second layer is a middle layer that is normally white. By providing an opaque layer sandwiched between the top and bottom layers, the middle layer prevents the bottom layer from being seen when viewed from the top or front and prevents the top layer from being seen when viewed from the bottom or back. The middle layer also normally provides the white portions of both the top and bottom images. The third layer is the top layer that will be seen when viewed from the top or front. Although more than three layers may be used to produce the same effect, additional layers are not required and can be merged down to the 3 layers described above with the use of computer software before printing.

Through the use of the present invention it is now possible to print a single image that has two sides. Through the use of the present invention an image can be printed on a transparent medium, and it is possible to view both sides of the two-sided image. The two-sided images created can be and frequently are aesthetically pleasing, enjoyable for personal use, excellent for educational uses—particularly in showing relationships not obvious from a 1-sided view, and/or in assisting in point of sale merchandising or for promotional applications.

There are many ways to use two-sided pictures. If the two-sided image is printed as a decal and applied to a transparent object, such as a glass, the decal is on only one side of the glass but provides two separate images.

The images used to create the two-sided pictures can include, but are not limited to, photographs, hand drawn images, and text. When created as a decal, two-sided pictures can be placed on a wide variety of transparent objects. Two-sided decals, when placed on a medium that can be cut, such as clear plastic, can be cut out and made into two-sided figurines.

Some of the uses of two-sided pictures include portraits of individuals or groups, pictures of products to attract attention and demonstrate the products' benefits, and pictures to help show people how to use products. Still further objects and advantages will become apparent from a consideration of the ensuing description and drawings.

The present invention advantageously enables people to enjoy a new type of visual image for personal use not previously available. It also allows vendors to attract attention to their products and educate people on how to use their products in ways not previously available.

In addition to pictures the present invention also advantageously enables the creation of decals that can be applied to a large number of transparent objects.

In one embodiment of the present invention text may be added to a two-sided image that says one thing when viewed from one side but something else when viewed from the other side.

In another embodiment of the present invention two-sided objects not in the original image can be added so that the object in the original image is seen to be on, in, or interacting with the added two-sided object.

In still another embodiment of the present invention, two-sided figurines can be created and cut out that can optionally be made self-standing.

In yet another embodiment of the present invention two-sided pictures can show images in different states instead of front and back images. Some examples of different states include customers or objects before and after use of a product, or sad and happy customers with and without the benefit of a vendor's product.

The present invention will be more fully understood from the accompanying drawings, which are intended to be read in conjunction with the description and preferred embodiments.

BRIEF DESCRPTION OF THE DRAWINGS

DRAWINGS—REFERENCE NUMBERS

Figure 1A:
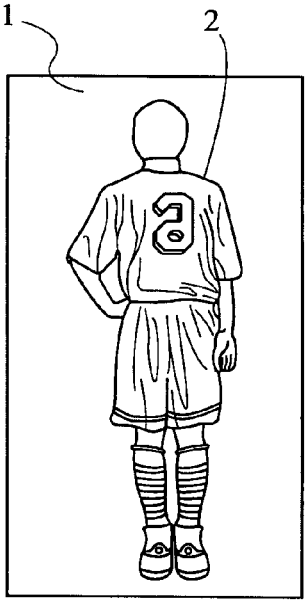
FIG. 1A is the bottom layer of a typical two-sided picture as seen when printed, before the next layer is printed on top of it.

1) Transparent Background
2) Bottom layer of flipped image
3) White layer
4) Top layer of image
5) Transparent drinking glass
6) Top layer of decal
7) Bottom layer of decal
8) Top text layer
9) Bottom text layer
10) White layer for text
11) Top layer of subject
12) Bottom layer of subject
13) Top layer of image to be added
14) Bottom layer of image to be added
15) Top layer after merging
16) Bottom layer after merging
17) Top decal layer added to plastic & cut
18) Transparent plastic medium
19) Front side of group
20) Front oval
21) Back side of group
22) Back oval
23) Front side of group on front oval
24) Back side of group on back oval
25) Front side of happy customer
26) Front side of sad customer

DETAILED DESCRIPTION OF THE INVENTION

The present invention is directed to a method of creating two-sided pictures.

Figure 1B:
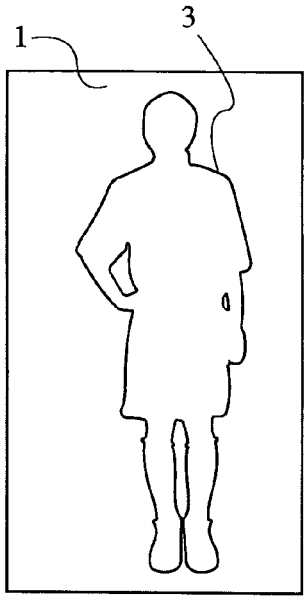
FIG. 1B shows the middle of the three levels of a typical two-sided picture.
Figure 1C:
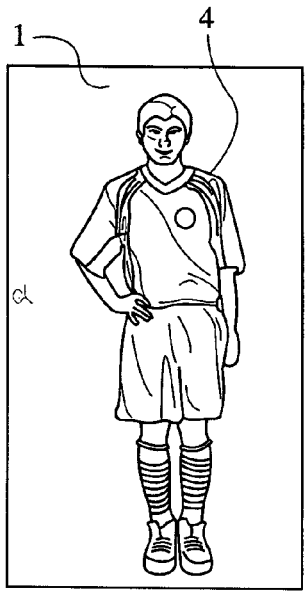
FIG. 1C is a front view of one of the three levels of a typical two-sided picture.

One embodiment of a two-sided picture is illustrated in FIGS. 1A to 1C. These figures show the three layers of a two-sided picture. FIG. 1A shows the bottom layer that is printed first, directly on the transparent medium (1). Note that the image has been reversed when printed so that it can properly be viewed through the transparent medium. (1). FIG. 1B is the middle white layer that is printed directly over the bottom image (2). FIG. 1C is the top layer that is printed directly over the middle white image (3).

The first step in creating a two-sided image is to obtain suitable front and back images. This can be done by drawing front and back images such that the front and back images are congruent, or scanning suitable congruent images into a computer, photographing front and back pictures such that the subject of the front and back photographs has nearly the same profile, or through other means that are appropriate for capturing or creating front and back images.

One method that could be used to obtain suitable photographs would be to set up two cameras directly opposite each other on tripods with the subject in the middle. The two cameras should be directly facing each other at the same height and each take a picture of the subject as near to the same time as possible, so as to allow no movement, or minimal movement, of the subject. Care must be taken to avoid lighting that is intended for one camera from causing glare in the other camera.

Once the two images are obtained they may be input into a computer by a scanner, digital camera download, or other means. An image-editing software program suitable to manipulate the images may then be used to achieve congruence of the two images. If the two images are from cameras, setting up the two cameras appropriately will minimize the amount of computer image editing necessary to achieve congruence of the front and back images.

After the images are input into a computer the objects to be shown in the final two-sided picture are digitally cut out and the backgrounds discarded. Since the bottom image will be viewed through the transparent medium, it must be flipped horizontally before printing, as in image (2) of drawing 1A. If the bottom image is the same as the top image it will not be flipped before printing and will be seen as a mirror image of the top image when viewed through the transparent medium.

If the top and bottom images are not completely congruent, one or both must be modified before printing. One method to achieve congruence of the two images is through the use of a computer image editing software program, whereby the back image is digitally placed over the front image. The back image, or portions of the back image, can then be stretched, shrunk, rotated or twisted until the back image completely covers the front image with as little overlap, distortion, or stretching as possible. It is also sometimes desirable to make some or all of the modifications to the front image. After the modifications have been made, any portion of the back image that is not directly covering some portion of the front image should be discarded. After this process minor image editing touch ups of the two images may be necessary to achieve pleasing final pictures.

Figure 4:
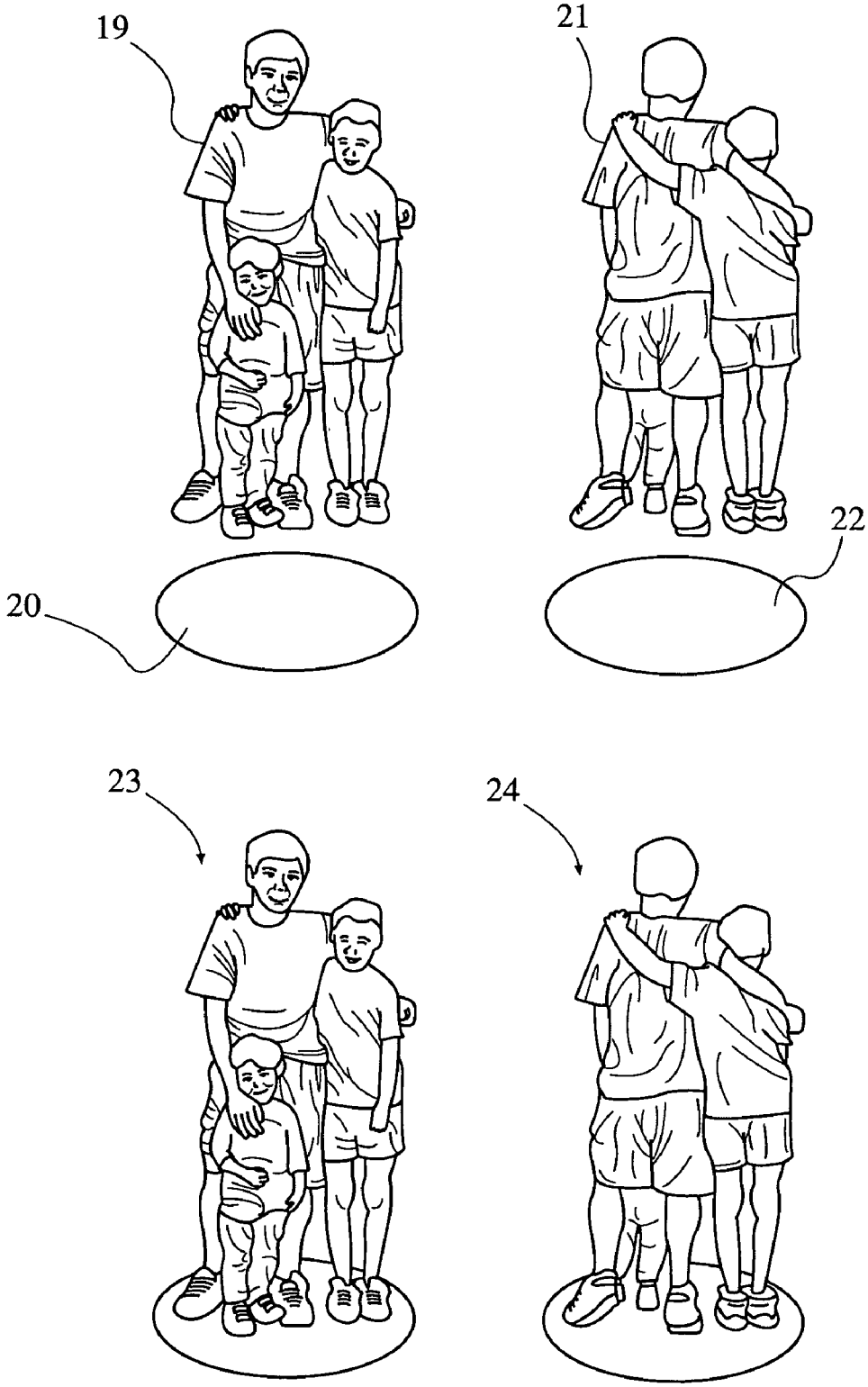
FIG. 4 illustrates a method for overcoming depth of field congruence problems.

Excessive depth of field can make achieving congruence of the front and back pictures difficult. This sometimes occurs when trying to achieve congruence of the back and the front of feet in a portrait. Achieving congruence in this situation can be simplified if the subject's feet face directly at the camera. If the depth of field is even larger, such as occurs if one person is standing or sitting in front of another, as in images (19) and (21) of FIG. 4, congruence may be very difficult. Moving the cameras farther apart can minimize, but may not completely solve this lack of congruence.

Another solution to depth of field congruence problems is to digitally place a small oval under the feet or bottom of the image. This is demonstrated in FIG. 4. Image (19) shows the front of a group of people with a young child in front of the others. Image (21) is the back of the same group. As can be seen, the front and back images of the young child's feet are in very different positions in images (19) and (21). It is possible to distort the two images to achieve congruence but this results in one or both of the front and back images looking unnatural. The excessive distortion necessary to achieve congruence may result in legs or feet at impossible angles or legs or feet that are stretched to improper lengths. By adding ovals (20) and (22) behind images (19) and (21) it is possible to achieve a pleasing compromise in images (23) and (24). The ovals give the illusion that the subjects are standing on the oval while hiding the lack of congruence between the feet in the front and back.

FIG. 1A is the bottom layer of a two-sided portrait. Image (2) is printed first on a transparent medium (1) such as vinyl. Note that the bottom image (2) has been flipped horizontally before printing. In this manner when viewed through the transparent medium (1) it will be viewed correctly.

A middle white layer, FIG. 1B, is then printed, if necessary, on top of the bottom layer such that it precisely covers the bottom layer. To precisely cover the bottom layer, the middle layer must completely cover the bottom layer, but not overlap the bottom layer. If the middle layer overlaps the bottom layer, the middle layer will show around the edges, when the bottom layer is viewed from the back, through the transparent medium.

The white middle layer is sandwiched between the top and bottom layers. One method to create the white layer is to make a copy of the bottom layer and print it precisely on top of the bottom layer using only white ink as in image (3). Normally one layer of white is not sufficiently opaque to completely cover the bottom layer and a multiplicity of white layers is necessary. If some white shows at the edges of an image in the completed two-sided picture, it may be necessary to remove the outer 2 or 3 pixels of white from the edges of image (3).

The middle layer serves two purposes. First, by providing an opaque middle layer, it prevents the front of the picture from being seen when viewed from the back and likewise prevents the back of the picture from being seen when viewed from the front. Second, the middle layer, if printed in white, serves as the white portions of the front and back images. If the front and back layers have been printed in a manner that includes the white coloration, or neither the front nor the back requires a white background to be viewed properly, and the front and back have both been printed dark enough to prevent the back or the front from showing through to the other side, then a middle white layer may not be required.

Sometimes it may be desirable to display a semi-transparent object as part of a two-sided picture. Semi-transparent objects such as water, fire, or smoke may be created by excluding the portion of the white middle layer that is printed between the front and back portions of objects that are semi-transparent. For even greater transparency it may be desirable to only print the top or bottom portions of semi-transparent objects.

Finally, the top layer, image (4) in FIG. 1C is printed precisely over the top of the middle white layers such that it completely covers, but does not overlap, the middle white layers.

Figure 5:
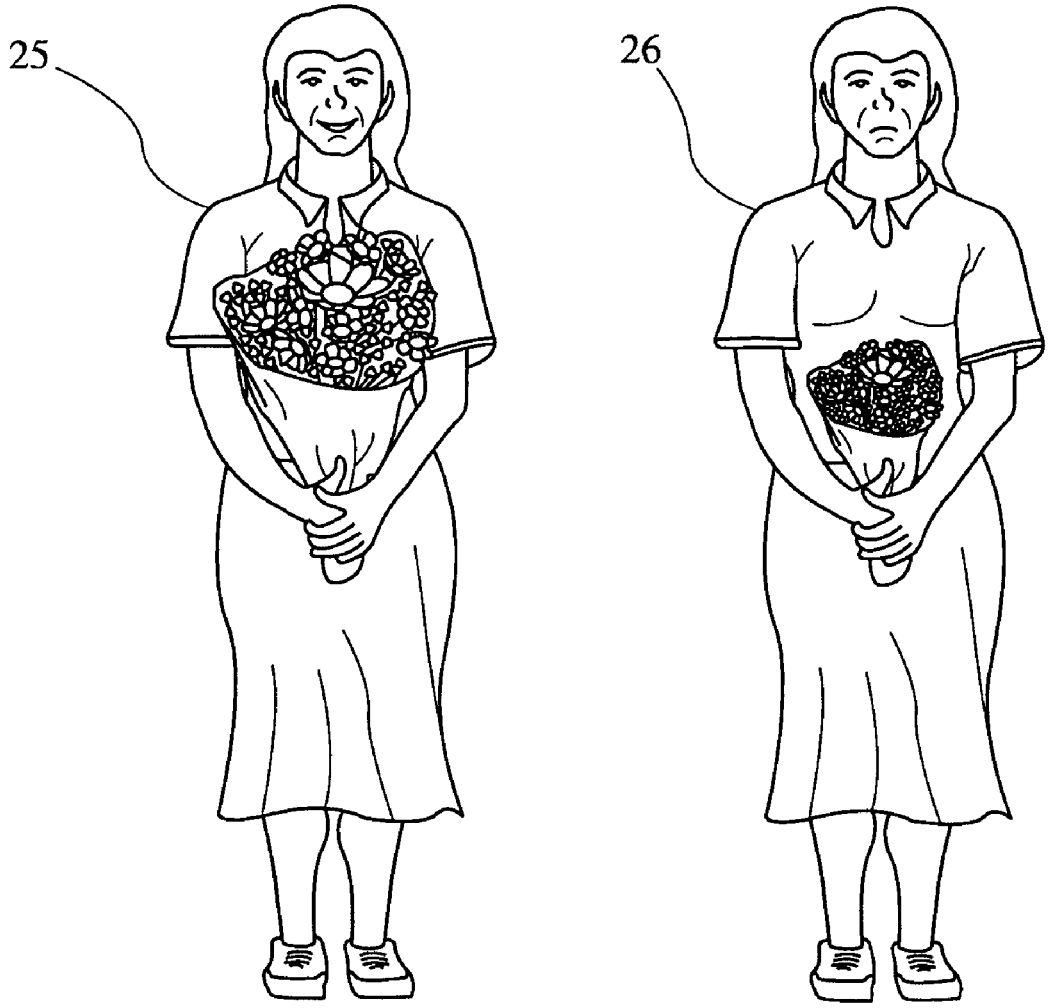
FIG. 5 shows a two-sided picture with the back and front displaying the same image but in different states.

Normally the top layer is the front of the object and the bottom layer is the back of the object. However, other options for the relationship of the front image and the back image are also possible. The back image could show the front image in a different state. For example the front could be a customer happy with a vendor's product as in image (25) of FIG. 5 and the back image (26) could be the front of the same customer unhappy with a competitor's product; or the images might show an object that has been painted or waxed shown in the front image and the back image the product before being painted or waxed. It is even possible that the front and back images are of two completely different people or objects that have the same outline. Still other variations of front and back images are possible.

It may be desirable for the front and back images to be exactly the same image. Having both images identical may be desirable for several reasons, including: (i) the unavailability of a back image; (ii) the image is to be displayed in a location where strong back lighting may result in the back image showing through to the front image; and/or (iii) due to excessive depth of field, or other problems, congruence cannot be easily achieved. If the front and back images are the same, then the back image should not be flipped horizontally before printing, but will be seen as a mirror image of the front image when viewed through the transparent medium.

Figure 2A:
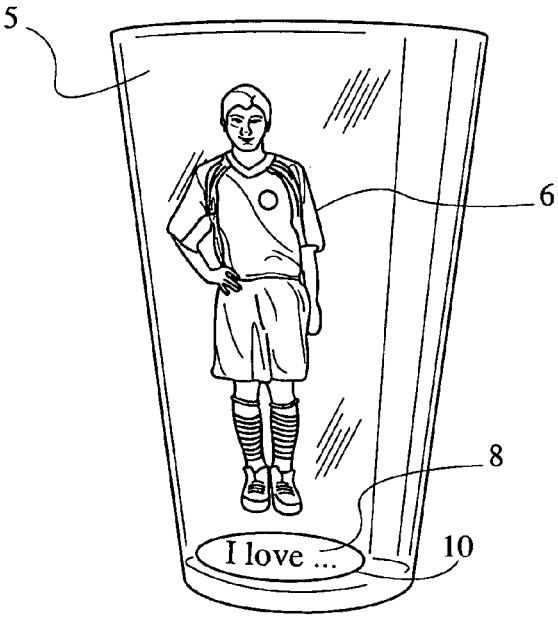
FIG. 2A shows one particular embodiment of the present invention, which is a front view of a glass that has a two-sided decal with text.
Figure 2B:
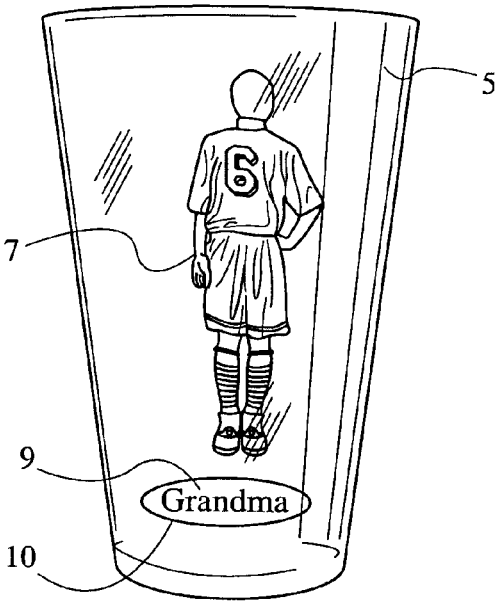
FIG. 2B shows one particular embodiment of the present invention, which is a back view of a glass that has a two-sided decal with text.

FIGS. 2A and 2B—Additional Embodiments

Two-sided images may also be printed on transparent decal material. What is meant by a decal, as used here, is any substance or procedure that allows for printing on one medium and subsequent application or transfer of the printed image to a different surface. Three of the most common methods of doing this are: 1) Printing on a medium that subsequently allows the transfer of the image to a different surface by soaking in liquid and then sliding the image onto that surface; 2) Printing on a medium, typically made of vinyl, that has an adhesive pre-applied on one side, such that after printing it can be directly applied to a different surface; and 3) Printing on a medium that allows transfer of the image to a different surface by use of a heat process.

The same method is used to create and print a two-sided decal as described in the detailed description for creating two-sided images. Depending on the hardiness of the decal created, the object to which it will be attached, and the intended use of the end product, it may be desirable to treat the decal with a hardening process, or coat the decal with a protective finish after it has been transferred to the final surface.

With a two-sided decal as in (6) and (7) of FIGS. 2A and 2B the decal may be placed on many transparent surfaces. Suitable surfaces include, but are not limited to, transparent versions of the following: drinking utensils, bowls, plates, vases, windshields, windows, doors, fish tanks, enclosures, sheets of glass, sheets of plastic, and transparent picture frames. In FIG. 2 a drinking glass (5) was used as the transparent surface.

FIGS. 2A and 2B also show the use of two-sided text (8) and (9) printed with a middle layer (10). Two-sided text may be used with two-sided decals or when printed directly on the transparent medium. Note that the bottom layer of the text must be flipped horizontally before printing. Image 2B shows how the bottom layer of text (9) is viewed after being printed and transferred to the final surface. Additional middle layers may be required to increase opacity and prevent text on one side from showing through to the other side. For two-sided text the middle layer serves as a background for the text and an opaque layer to prevent one layer from interfering with the other layer; it does not normally serve to add white to the image. The middle layer for two-sided text therefore, does not have to be white, but can be any color that works with the printer being used and results in an acceptable color combination with the text color.

FIGS. 2A and 2B show text as a separate area of the picture. If the text is printed directly in front or behind the main images, the front text can be merged with the front image and the back text can be merged with the back image before printing. Alternatively the text can be printed as separate levels. If the text is printed as separate levels and there is text to be viewed from both sides and a there is a white middle layer there may be as many as 5 levels to print in the following order: 1) the back text, 2) the back image, 3) the middle white layer, 4) the top image, and 5) the top level text.

FIGS. 3A to 3D—Decals and Cutouts

Figure 3A:
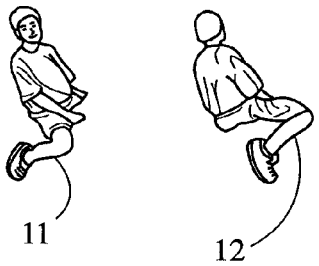
FIGS. 3A, 3B, 3C and 3D illustrate the steps for combining a two-sided picture with a two-sided object not in the original picture.
Figure 3B:
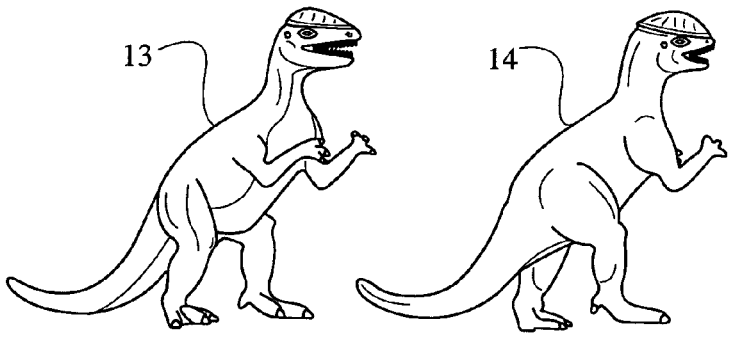
Figure 3C:
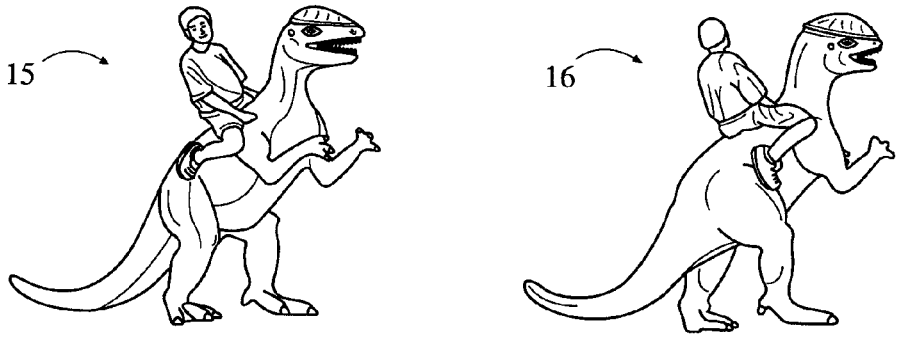

FIGS. 3A to 3C illustrate a method for combining two or more two-sided images to create one two-sided image. Images (11) and (12) of FIG. 3A show the front and back of a young boy that was photographed from the front and back while sitting on a short stool. The stool and background of FIGS. (11) and (12) were cut out and discarded with a computer image editing software program. A two-sided dinosaur (13) and (14) of FIG. 3B that was previously created and stored in the computer was combined with the 2 images of the boy. The boys left leg of image (11) was behind the dinosaur (13) in the final front image (15) of FIG. 3C and was therefore also cut out and discarded. Similarly the boy's left leg of image (12) was removed from the back image (16) because it should not be seen when combined with the back of the dinosaur, image (14), to create image (16).

Finally image (11) was combined with image (13) to create image (15) of FIG. 3C and image (12) was combined with image (14) to create image (16) of FIG. 3C. Images (15) and (16) must be made congruent as described for FIGS. 1A to 1C.

Figure 3D:
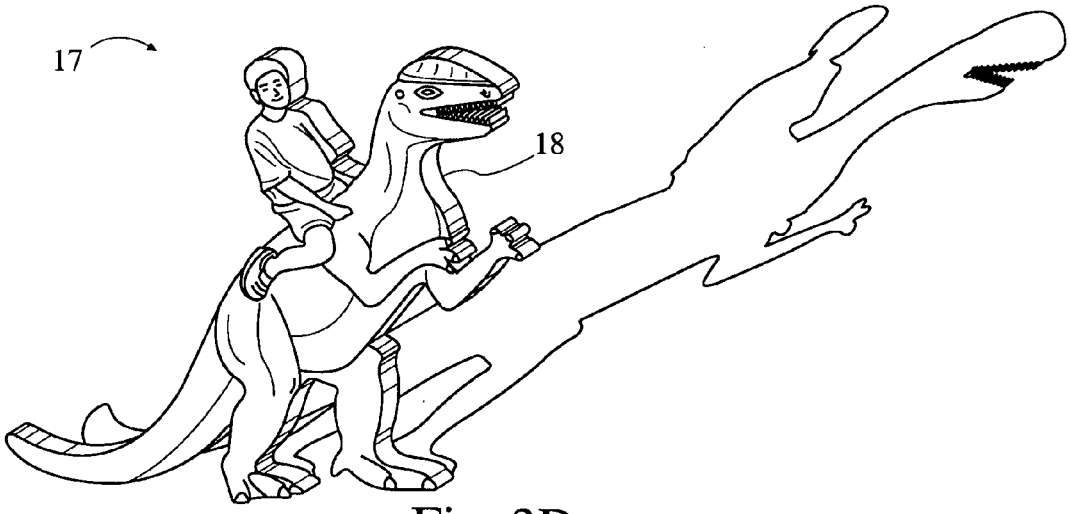

FIG. 3D illustrates a two-sided decal (17) that has been placed on transparent plastic (18) and cut out. The two-sided cutout may optionally be placed on a stand so that it will be freestanding.

While the present invention has been described above in terms of specific embodiments, it is to be understood that the invention is not limited to these disclosed embodiments. Variations are possible within the teachings of the present invention. The scope of the invention should be determined by proper interpretation and construction of the appended claims and their legal equivalents.

What is claimed is:

1. A method for creating one 2-sided picture from a first single sided picture and a second single sided picture, comprising the steps of:

a. removing the backgrounds from both said single sided pictures leaving just a first object from the first single sided picture and a second object from the second single sided picture to be printed, and b. modifying the shapes of one or both said objects, that have had said backgrounds removed, in order to make said objects congruent, such that said shape modifications result in minimal distortion of the images, and c. printing said first object onto a transparent medium, and d. printing an intermediate opaque white layer on said first object such that said white layer completely covers said first object but does not extend beyond the edges of said first object, and e. printing said second object over said white intermediate layer such that said second object completely covers said white layer but does not extend beyond the edges of said white layer, whereby the resultant 2-sided image shows said object from 2 opposite sides.

2. The method of claim 1 further stipulating that said transparent medium comprising decal material.

3. The method of claim 1 further stipulating that said transparent medium comprising a transparent rigid material suitable for physically cutting.

4. A method for creating one 2-sided picture from a first single sided picture and a second single sided picture, comprising the steps of:

a. removing the backgrounds from both said single sided pictures leaving just a first object from the first single sided picture and a second object from the second single sided picture to be printed, and b. modifying the shapes of one or both said objects, that have had said backgrounds removed, in order to make said objects congruent, such that said shape modifications result in minimal distortion of the images, and c. printing said first object onto a transparent medium, and d. printing said second object over said first object such that said second object completely covers said first object but does not extend beyond the edges of said first object, whereby the resultant 2-sided image shows each respective object from 2 opposite sides.

5. The method of claim 4 further stipulating that said transparent medium comprises decal material.

6. The method of claim 4 further stipulating that said transparent medium comprises a transparent rigid material suitable for physically cutting.

* * * * *